US008925651B2

(12) United States Patent
McDougall et al.

(10) Patent No.: US 8,925,651 B2
(45) Date of Patent: Jan. 6, 2015

(54) HYDRAULIC DRILLING METHOD WITH PENETRATION CONTROL

(75) Inventors: Myles McDougall, Calgary (CA); Jeremy Nielsen, Calgary (CA); Carl Tatman, Calgary (CA)

(73) Assignee: Petrojet Canada, Inc., Calgary, Alberta (CA)

( * ) Notice: Subject to any disclaimer, the term of this patent is extended or adjusted under 35 U.S.C. 154(b) by 1011 days.

(21) Appl. No.: 12/992,836

(22) PCT Filed: May 13, 2009

(86) PCT No.: PCT/CA2009/000652

§ 371 (c)(1),
(2), (4) Date: Jul. 13, 2011

(87) PCT Pub. No.: WO2009/137923

PCT Pub. Date: Nov. 19, 2009

(65) Prior Publication Data

US 2012/0186875 A1 Jul. 26, 2012

Related U.S. Application Data

(60) Provisional application No. 61/052,801, filed on May 13, 2008.

(51) Int. Cl.

| | |
|---|---|
| ***E21B 7/08*** | (2006.01) |
| ***E21B 7/06*** | (2006.01) |
| ***E21B 7/18*** | (2006.01) |
| ***E21B 44/02*** | (2006.01) |

(52) U.S. Cl.

CPC . *E21B 7/061* (2013.01); *E21B 7/18* (2013.01); *E21B 44/02* (2013.01)

USPC ..... 175/61; 175/67; 175/75; 166/117.5

(58) Field of Classification Search

CPC ..... E21B 7/18; E21B 10/60; E21B 7/065; E21B 7/061

USPC ..... 175/67, 27, 77, 78, 61, 62, 75, 65; 299/16, 17; 166/117.5

See application file for complete search history.

(56) References Cited

U.S. PATENT DOCUMENTS 3,599,733 A * 8/1971 Varley ..... 175/61
4,527,639 A * 7/1985 Dickinson et al. ..... 175/61

(Continued)

FOREIGN PATENT DOCUMENTS

| | | |
|---|---|---|
| CN | 2615322 | 5/2004 |
| CN | 1877074 | 12/2006 |
| RU | 2255196 | 6/2005 |

OTHER PUBLICATIONS

International Search Report mailed Sep. 15, 2009, for International Application No. PCT/CA2009/000652.

*Primary Examiner* — Nicole Coy

(74) *Attorney, Agent, or Firm* — Colin P. Cahoon; Celina M. Orr; Carstens & Cahoon, LLP

(57) ABSTRACT

A system and method for hydraulic drilling is provided. A whipstock having a bore can be sealingly engaged at a distal end of a workstring. A drilling apparatus having drill tubing and a flow through device for routing drilling fluid into the drill tubing can be connected to the end of a connection string and inserted down into the work string so that the drill tubing extends through the bore in the whipstock device. Pressurized drilling fluid can then be inserted into the annulus formed between the work string and the connection string so that the pressurized drilling fluid passes through the flow through device into the drilling tube and is discharged out the distal end of the drilling tube as a cutting jet.

35 Claims, 3 Drawing Sheets

(56) References Cited

U.S. PATENT DOCUMENTS

| | | | | |
|---|---|---|---|---|
| 4,640,353 | A | 2/1987 | Schuh | |
| 4,693,327 | A * | 9/1987 | Dickinson et al. | 175/61 |
| 4,763,734 | A * | 8/1988 | Dickinson et al. | 175/61 |
| 4,872,509 | A * | 10/1989 | Dickinson et al. | 166/278 |
| 5,255,750 | A * | 10/1993 | Wilkes et al. | 175/61 |
| 5,373,906 | A * | 12/1994 | Braddick | 175/67 |
| 6,457,540 | B2 * | 10/2002 | Gardes | 175/62 |
| 6,745,855 | B2 * | 6/2004 | Gardes | 175/62 |

* cited by examiner

HYDRAULIC DRILLING METHOD WITH PENETRATION CONTROL

This invention pertains generally to hydraulic drilling apparatuses and methods and, more particularly, to a system and method for supplying drilling fluid downhole for hydraulic drilling.

BACKGROUND OF THE INVENTION

In hydraulic drilling operations, a highly pressurized drilling fluid is discharged through a drill head as a high velocity cutting jet which cuts away the material at which it is directed to form a borehole. As the material is removed, the drill head is advanced to extend the borehole into the earth. The drill head is typically attached to a tubular work string to which the pressurized fluid is applied, and the force exerted on the work string and head by the fluid drives them in the forward direction. The rate at which the drill head advances is limited by a cable which is attached to the work string and played out at a controlled rate.

The use of the restraining cable has certain limitations and disadvantages. It requires not only the cable itself but also a drum or storage reel for the cable and a brake or some other means for controlling the rate at which the cable is played out. Under significant tension the cable (whether holding back the drill string or while being used to retract the drill string) will stretch, making it difficult to precisely control the rate of penetration of the drill string. There is also a possibility that the cable may break, which would necessitate shutting down the drilling operation to recover the drill head, repair the cable, and possibly also repair or replace the drill head in the event that it is damaged by impacting with the formation when the cable breaks.

The method described in U.S. Pat. No. 5,255,750 resolved at least some of the aforementioned concerns through the creation of a "hydraulic brake" which utilized a set of dual acting seals, one sealing the outer diameter (OD) of the drilling apparatus and the second sealing the drilling apparatus inside a continuous cylinder the length of the drilling apparatus. In between these seals, a fixed sized orifice is installed to allow the fluid that is trapped within these seals to escape, thus decreasing this volume of fluid and allowing the drilling apparatus to move at a controlled rate of penetration.

The use of this seals/orifice system had several limitations and disadvantages. The seals have to work in a harsh particle filled environment that is typical of an oil or gas well drilling operation and in some cases leakage of the seals will cause the system to fail. The orifice also has to maintain a very precise size and shape, while operating at high pressures and temperatures and allow abrasive material to pass through without eroding. The combination of length of the drilling apparatus and the continuous cylinder has to be planned before the operation and cannot be altered or the seals will not seat simultaneously. In addition, once the orifice is selected to give a desired rate of penetration, this rate cannot be changed to allow for a faster or slower rate of penetration without bringing the entire drilling apparatus to surface and physically changing that orifice.

In addition, with the seals/orifice method a separate piece of equipment must be used to lower the drilling apparatus from surface into position for the seals to seat. This requires a cable and a drum with the ability to control the rate at which the cable and drilling apparatus is spooled out. Once the drilling apparatus has completed its hydraulic drilling operation, a method must be implemented to retract that drilling apparatus back into the original well (as a minimum) or all the way back to surface to repair the seals or change the orifice.

SUMMARY OF THE INVENTION

In a first aspect, a hydraulic drilling system is provided. The system comprises: a work string for placement down a wellbore having a distal end, a proximate end and an interior surface; a whipstock device provided at the distal end of the work string and having a bore; a connection string provided passing inside the work string, the connection string forms an annulus between the connection string and the interior surface of the work string, the connection string having a proximate end and a distal end; and a drilling apparatus connected to the distal end of the connection string, the drilling apparatus having a flow through device connected to a proximate end of a drill tubing, the drill tubing having an inner bore open at a distal end of the drill tubing, the flow through device having at least one conduit placing the annulus in fluid communication with the inner bore of the drill tubing, the drill tubing passing through the bore of the whipstock. When pressurized drilling fluid is introduced into the annulus, the drilling fluid can enter the drill tubing through the flow through device and be discharged out the distal end of the drill tubing.

In another aspect, a method of hydraulic drilling is provided. The method comprises: sealingly engaging a whipstock device with an interior surface of a work string at a distal end of the work string, the whipstock having a bore passing therethrough; providing a drilling apparatus having: drill tubing having an inner bore, a proximate end and a distal end and a flow through device, the flow through device having at least one conduit placing an annulus formed by the interior surface of the work string in fluid communication with the inner bore of the drill tubing when the drilling apparatus is inserted in the work string; connecting the drilling apparatus to a connection string and inserting the drilling apparatus down into the work string; inserting at least a portion of the drill tubing through the whipstock; and introducing pressurized drilling fluid into the annulus, the pressurized drilling fluid passing through the flow through device into the drilling tube and discharged out the distal end of the tube as a cutting jet.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
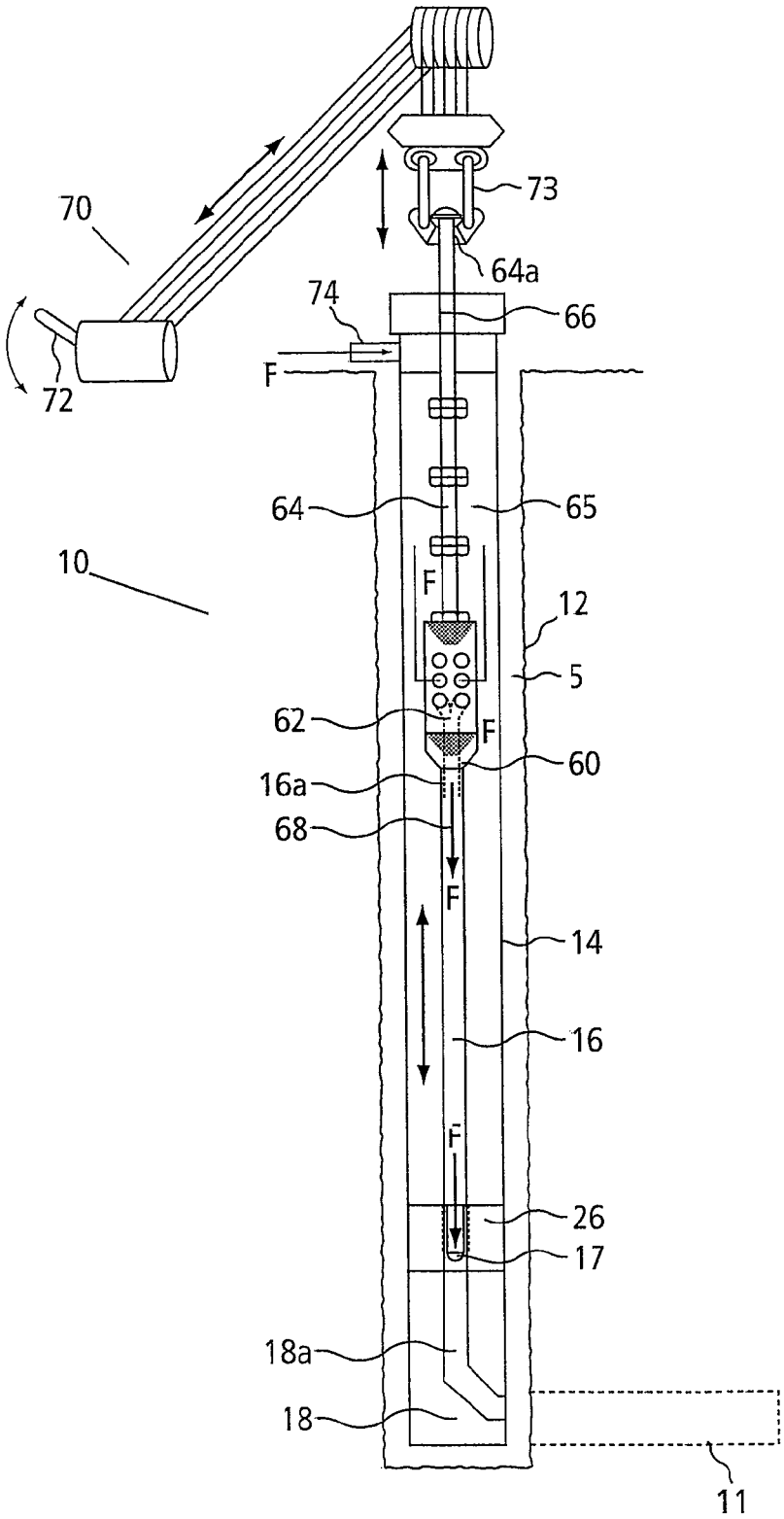
FIG. 1 is an elevational schematic view of one embodiment of a drilling apparatus according to the invention.

FIG. 1 illustrates a drilling apparatus in one aspect. In FIG. 1, the apparatus is illustrated in connection with the drilling of a lateral bore hole 11, shown in phantom, which extends from a main borehole 12 in the earth. Main borehole 12 can be vertical, deviated or horizontal and may be the borehole extending from surface or a lateral therefrom.

The drilling apparatus 10 can include a tubular work string 14 which extends in the main borehole 12. A whipstock 18 may be connected to the lower end of the string. Whipstock 18 includes a bore 18*a* therethrough formed to allow the movement of a drilling tube 16 through the bore 18*a*. In one aspect, rollers could be provided in the bore to aid the passage of the drilling tube 16 through the bore 18*a*. The bore 18*a* acts to bend any drilling tube 16 advancing therethrough and to direct it outwardly from the long axis of the work string 14.

The drilling apparatus 10 further includes a drilling tube 16. The tube 16 is movable axially within the work string 14, and a distal end portion of the tube 16 includes a drill head 17. An inner bore 16*a* passes through the drilling tube 16 and is open at the drill head 17. The drill head 17 can be of any suitable design, and in one embodiment, it includes a nozzle that opens from its inner bore to its outer surface and which acts to produce a cutting jet capable of breaking down formation materials, such as for example, the nozzle disclosed in U.S. Pat. Nos. 4,787,465, 4,790,394 and U.S. Pat. No. 6,206,112.

In addition to producing the cutting jet, the drilling fluid exerts a force on the drill head 17 which drives the drilling tube 16 and the drill head 17 in the forward direction into the main borehole 12, away from surface, as described, for example, in U.S. Pat. No. 4,763,734.

For use to drill a borehole, the lateral drilling tube 16 is positioned in the bore 18*a* of the whipstock 18. By advancement of the drilling tube 16 through the bore 18*a* of the whipstock 18, the distal end portion of the drilling tube 16 may be directed away from the main borehole 12 to form lateral borehole 11. A seal 26 may be provided in bore 18*a* to control, for example prevent, fluid flow through the interface between the tube 16 and the whipstock bore 18*a*.

At an upper end of lateral drilling tube 16 is a flow through device 60. The flow through device 60 includes at least one conduit 62 opening at a first end on the outer surface of the flow through device 60 and extending to open into the inner bore 16*a* of lateral drilling tube 16. Conduit 62 provides that any fluid contacting the outer surface of flow through device 60 may be communicated to the inner bore 16*a* of drilling tube 16 and therethrough to drill head 17. (See arrows F)

Flow through device 60 and lateral drilling tube 16 are positioned in string and moveable axially therein by mounting on a connection string 65 comprising a string of rods 64, such as sucker rods. As will be appreciated, sucker rods are used in well operations, for example, to drive downhole pumps, etc. Rods 64 may include standard form sucker rods, polish rods, etc. Rods 64 may be solid rods or in any event in the current invention are intended to position and control movement of the drilling tube 16 rather than to convey fluids. Rods 64 may be connected to form a string such that the flow through device 60 can be lowered to a selected position within the work string 14. Rods 64 may be added to the upper end 64*a* of the string to extend the length of the string.

Upper end 64*a* of the string of rods 64 may extend from the top of the work string 14, for example, at surface. An upper sealing element 66 can provide a seal between the work string 14 and rods 64 such that a sealed annulus 68 is created about the rods 64/flow through device 60/drilling tube 16 and an inner wall of the work string 14. As noted hereinbefore, annulus 68 is sealed at its lower end by seal 26. The rod 64 passing through the upper sealing element 66 can be a polish rod to maintain the seal between the rod 64 and the upper sealing element 66. In one aspect, it may be desirable to have a number of lengths of the rod 64 be polish rod near the upper end 64*a* of the string of rods 64.

The upper end 64*a* of the rod 64 string may be connected to a rig drawworks 70 including a brake 72. A means, such as a rig elevator and traveling block 73, secure the rod string 64 to the drawworks 70.

Brake 72 may be operable in various ways. If there is a desire to avoid manual operation of the brake 72, the brake 72 may include an automated or remote operation system. In one embodiment, for example, the brake 72 may be operated by an automated system that monitors the tension in the drawworks 70 and operates the brake 72 to maintain the tension in a selected range. The brake 72 may be operated by a motor, for example. The tension may be monitored, for example, by a tensiometer installed on the drilling line, drawworks 70, etc. Such tension readings may be fed back to a controller for the brake motor automatically or by manual monitoring and directed instructions to the controller.

A method according to one aspect of the present invention includes: running a work string 14 into an existing vertical, deviated or horizontal wellbore 12. At the bottom of this work string 14 a whipstock device 18 can be provided that deflects the drilling apparatus 10 away, for example in a radial direction from the long axis of the existing wellbore 12.

The drilling apparatus 10 is inserted inside this work string 14 from the surface. The drilling apparatus 10 includes a length of drill tube 16 with a drill head 17 attached to the distal end of the drill tube 16 and a flow through device 60 attached to the upper end of the drill tube 16. This drilling apparatus 10 is lowered into wellbore 12 by making up joints of rods 64, such as sucker rod, each joint advancing the drilling apparatus 10 further into the existing wellbore 12.

The whipstock 18 includes a seal 26 that is formed to seal against the outer diameter of drill tube 16 and maintains pressure containment in the annulus 68 while allowing the tube 16 to move forward through the seal 26.

Once the drillhead 17 enters the sealing device 16, a surface sealing device 66 is incorporated at the surface facility and the rods 64 are left connected to the drilling rig or service rigs traveling blocks via conventional tools. High pressure fluid is inserted into the system below this surface seal 66, such as through a port 74. This high pressure fluid is pumped down the work string 14 and enters the drilling apparatus 10 at the flow through device 60.

Once inside the drilling apparatus 10, the fluid flows to the drillhead 17 where the pressure causes a force to be created effectively pulling down on the drilling apparatus 10. The fluid also exits the drillhead 17 as a high-speed cutting jet which is directed at the formation that is to be cut away to create a lateral bore 11.

This downward force created by the high pressure is resisted by the brake 72 already incorporated into the drawworks 70 of the rig utilized in the operation. By letting off pressure on the brake 72, the rig operator allows the entire drilling apparatus 10 to move forward and penetrate the formation at any rate that is desired.

When the drilling apparatus 10 has completed the prescribed lateral bore 11, it can be retracted immediately by using the drawworks 70 to pull the apparatus backwards through the whipstock device 18. If desirable, whipstock 18 can be re-oriented and the drilling apparatus 10, if not already in position, may be re-set into the bottom seal 26 and another lateral bore (not shown) may be drilled. This process can be repeated many times.

The device and method have a number of important features and advantages. It allows the use of rods 64 to deploy and retract the drilling apparatus 10. Rods 64 are cheap and plentiful in most oilfields. Rods 64 can be used to "work" the drilling apparatus 10 to provide increased probability of achieving the length of the lateral bore 11 desired. Also, the invention allows the use of a rig's drawworks 70 and brake 72 (which is already needed in the operation) to restrict and control the rate of penetration of the drilling apparatus 10.

Figure 2:
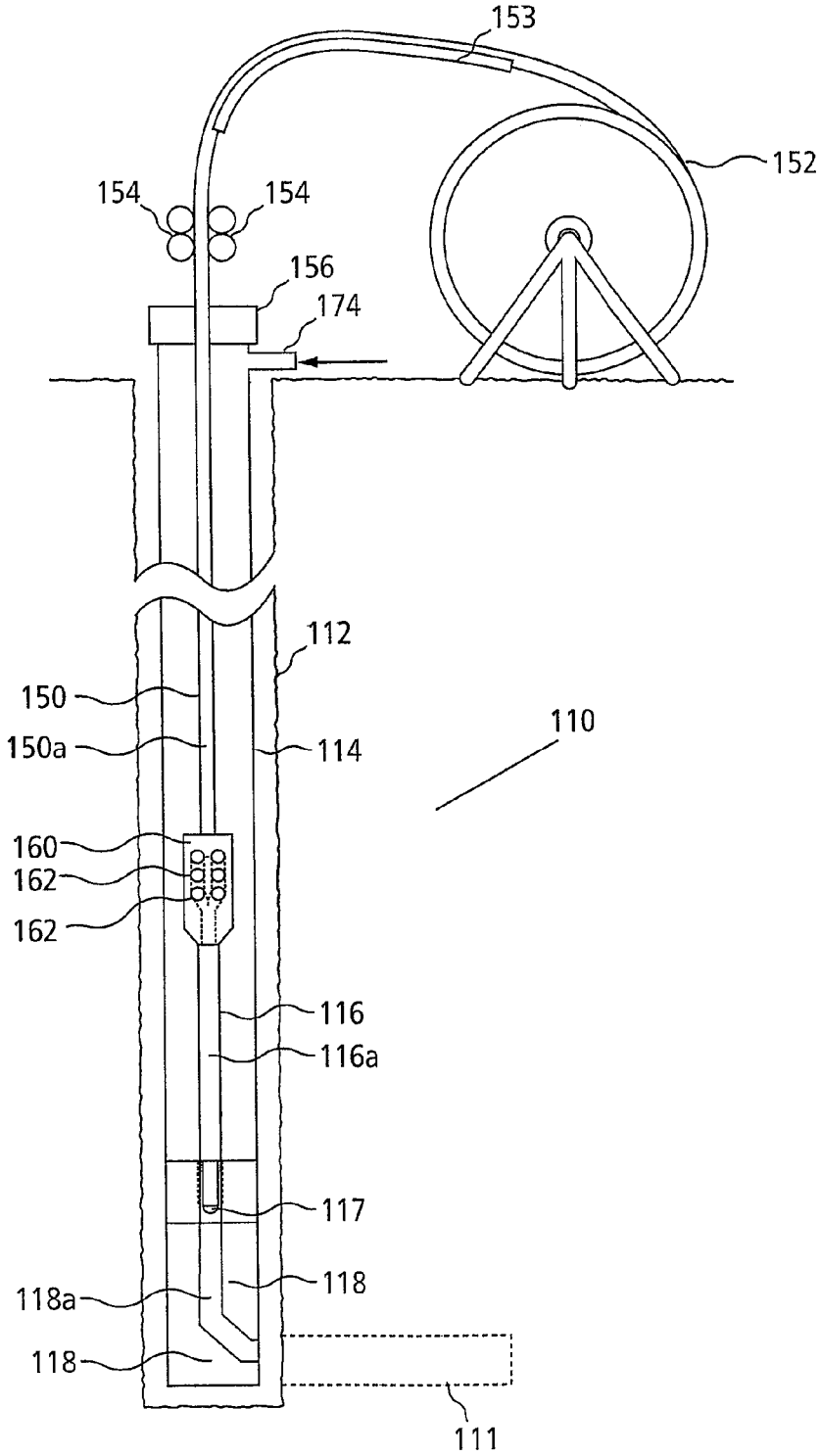
FIG. 2 is an elevational schematic view of another embodiment of a drilling apparatus according to another aspect of the invention.

FIG. 2 illustrates a drilling apparatus 110 in a further aspect. A tubular work string 114 can be inserted into a main borehole 112. A whipstock 118 can be connected at a lower end of the work string 114 and can have a bore 118*a* passing through the whipstock 118.

The drilling apparatus 110 can have a drill tube 116 that can be inserted through the bore 118*a* of the whipstock 118. The bore 118*a* of the whipstock 118 can alter the direction of the drill tube 116 as it is passed through the whipstock 118. The bore 118*a* can act to bend the drill tube 116 outwardly from the long axis of the work string 114. A drill head 117 can be provided on a distal end of the drill tube 116. The drill head 117 can be any suitable design including a nozzle, to produce the desired cutting jet.

A flow through device 160 can be provided at an upper end of the drill tube 116. The flow through device 160 can have one or more conduits 162 that place the bore 116*a* of the drill tube 116 in fluid communication with the annulus formed by the work string 114.

The flow through device 160 can be connected to a distal end of a continuous connection string 150 made up of continuous rod, continuous coiled tubing, etc. For the purposes of the description, continuous is meant to refer to a length of connection string that is unbroken along its length that is passed down the main bore hole 115, in comparison to a connection string formed of a plurality of rods connected end to end. A reel 152 holding the connection string 150 and a gooseneck 153 can be provided at the surface with an injector head 154 to feed the connection string 150 into the work string 114. A stripper 156 can be provided at a top end of the work string 114 to provide a seal between the work string 114 and the connection string 150.

The drilling apparatus 110 can be used to drill a lateral bore hole 111 by using the connection string 150 to advance the drill tube 116 through the whipstock 118 and out laterally into the lateral borehole 111. By controlling the amount of connection string 150 passed through the injector head 154 and down the work string 114, the advancement/penetration of the head 117 of the drill tube 116 can be controlled.

Drilling fluid can be pumped into the annulus formed between the connection string 150 and the work string 114 and can be pressurized in the annulus, such as through a port 174. The pressurized drilling fluid in the annulus can pass through one of the conduits 162 in the flow through device 160 into the bore 116*a* of the drill tube 116 to be discharged as a cutting jet out the drill head 117. As the cutting jet discharging from the drill head 117 cuts into the lateral bore hole 111, the coil tubing injector head 154 can be used to advance the connection string 150 down the work string 114 and thereby advancing the drill tube 116 through the whipstock 118 and further into the lateral bore hole 111.

Figure 3:
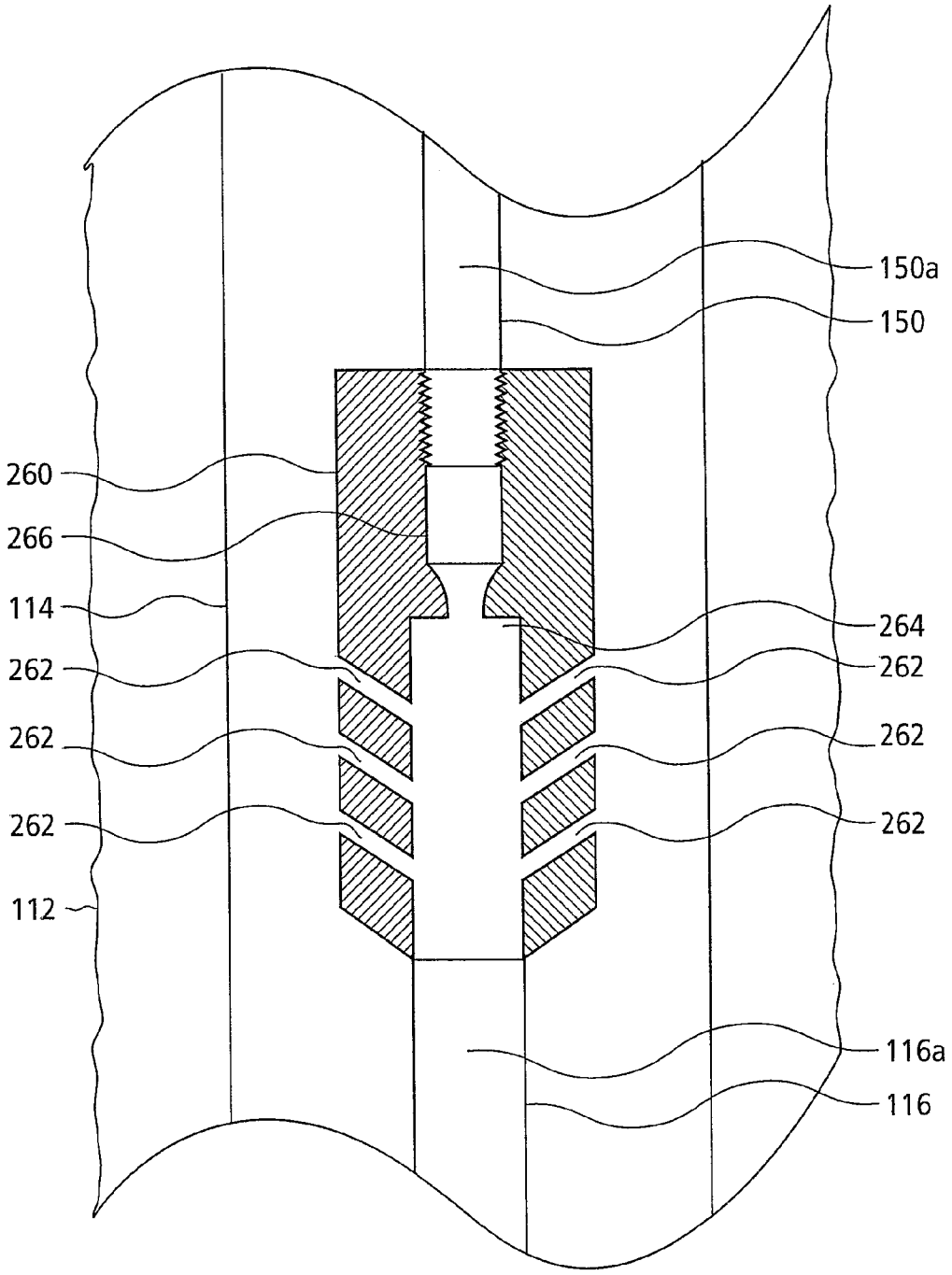
FIG. 3 is a schematic illustration of a flow through device.

The drilling apparatus 110 shown in FIG. 2 can use a single type of drilling fluid routed into the annulus between the work string 114 and the connection string 150 to produce the cutting jet. However, in some cases, it may be desirable to mix an additional fluid with the drilling fluid. FIG. 3 illustrates a flow through device 260 in a further aspect. Flow through device 260 can be used with the drilling apparatus 110 shown in FIG. 2 when the connection string 150 being used is coiled tubing having an inner bore 150A, to add an additional fluid to the drilling fluid being used to hydraulically drill the lateral bore hole 111.

The flow through device 260 can have a number of conduits 262 leading into an internal passage 264. A bottom end of the flow through device 260 can be connected to the drill tube 116 and the internal passage 264 can be in fluid communication with the bore 116*a* of the drill tube 116. The conduits 262 place the annulus between the work string 114 and the connection string 150 in fluid communication with the internal passage 264 and the bore 116*a* of the drill tube 116. When the annulus is filled with pressurized drilling fluid, the pressurized drilling fluid can enter the drill tube 116 through the conduits 262 in the flow through device 260, pass into the internal passage 264 of the flow through device 260 and then into the bore 116*a* of the drill tube 116.

A one way flow valve 266 can be provided between a bore 150*a* of the connection string 150 and the internal passage 264. An additional fluid, different from the drilling fluid, can be passed down the bore 150*a* of the connection string 150 where it can pass through the one way valve 266 and into the internal passage 264 of the flow through device 260. The additional fluid could be any suitable fluid that differs from the drilling fluid including, but not limited to, water, acids, potassium chloride, abrasive slurry, nitrogen, other chemicals or materials, etc., singularly or in combination.

In this manner, a direct conduit can be provided from the ground surface through the bore 150*a* of the connection string 150 into the flow through device 260 to mix with the drilling fluid entering the flow through device 260 through the conduits 262. The one way valve 266 can allow the additional fluid passing down through the bore 150*a* of the connection string 150 to enter the internal passage 164, yet prevent drilling fluid entering bore 150*a* of the connection string 150 from the internal passage 164.

In one aspect, the one way valve 266 and/or the conduits 262 can be arranged to cause the additional fluid to mix with the drilling fluid, such as by the venturi effect, as the additional fluid and the drilling fluid mix in the internal passage 264.

For example, if the additional fluid being used is an abrasive fluid for jet drilling of the steel casing or abrasive assisted cutting of rock, an abrasive fluid can be delivered through the bore 150*a* of the connection string 150 to be mixed with drilling fluid in the flow through device 260. By adjusting the respective pressures and flows, a mixture deemed optimal for the purposes of jet drilling could be achieved. The main source of the high pressure and flow desired would enter as drilling fluid through the flow through conduits 262 of the flow through device 260 from the annulus between the work string 114 and the connection string 150 where the impact of friction would be significantly lower than the friction to be found within the smaller diameter of the bore 150*a* of the connection string 150. The abrasive fluid that entered the flow through device 260 from the connection string 150 would then be augmented by the dominant higher pressure and flow of drilling fluid from the annulus thereby delivering the required slurry of additional fluid and drilling fluid with the required pressure and flow at the drill head 117. In the case that the abrasive slurry was only required to cut a hole in steel casing, once it was determined that the drill head 117 had penetrated the casing the slurry flow originating from the connection string 150 would be discontinued. The drilling process could then continue without the abrasive additive provided as additional fluid through the connection string 150.

In the event that the jet drilling process encountered difficulties due to a particularly hard to cut rock, an additional fluid such as an abrasive fluid could be re-introduced into the drilling fluid entering the flow through device 260 through the conduits 262 by simply starting an additional fluid flow down the connection string 150 to mix with the drilling fluid before it is discharged as a cutting jet.

Once the lateral bore hole 111 has reached its target penetration into the formation (e.g. 30 meters, 50 meters, 100 meters), the flow through device 260 could allow the introduction of an additional fluid, such as an acid, other chemical, etc. to help stimulate the lateral bore hole 111 by injecting a mixture of the additional fluid and drilling fluid into lateral bore hole 111. As the drill head 117 would already be at the toe of the lateral bore hole 111, no tripping would be required. By coordinating the pressure, flows and chemicals of the additional fluid and the drilling fluid, an acid or chemical treatment of a newly drilled lateral bore hole 111 can be achieved.

In a further aspect, coordination of the additional fluid and drilling fluid in combination with a sealing of the return flow between the work string 114 and casing of the main bore hole 112 would allow an acid squeeze to be performed.

In a further aspect, the pressure and flow could be calibrated and other desired elements introduced including water, acid, sand or other proppants as additional fluid through the connection string 150 to provide for a hydraulic or acid frac from the toe of the lateral bore hole 111. In this aspect, the drilling tube 116 could be fitted with a inflatable packer near the drillhead 117, that would seal the drill head area from the rest of the lateral bore hole 111 and the main bore hole 112.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The invention claimed is:

1. A hydraulic drilling system, the system comprising:

a work string for placement down a wellbore having a distal end, a proximate end and an interior surface;

a whipstock provided at the distal end of the work string and having a bore;

a connection string provided passing inside the work string, the connection string forms an annulus between the connection string and the interior surface of the work string, the connection string having a proximate end and a distal end; and a drilling apparatus connected to the distal end of the connection string, the drilling apparatus having a flow through device connected to a proximate end of a drill tubing, the drill tubing having an inner bore open at a distal end of the drill tubing, the flow through device having at least one conduit placing the annulus in fluid communication with the inner bore of the drill tubing, the drill tubing passing through the bore of the whipstock, wherein when pressurized drilling fluid is introduced into the annulus, the drilling fluid can enter the drill tubing through the flow through device and be discharged out the distal end of the drill tubing; and the connection string having an inner bore and the flow through device is in fluid communication with the inner bore of the connection string to allow an additional fluid to be routed through the inner bore of the connection string to mix with drilling fluid from the annulus in the flow through device before entering the inner bore of the drill tubing.

2. The hydraulic drilling system of claim 1 further comprising a lower sealing element proximate a distal end of the work string and sealingly engaged between the interior surface of the work string and the drill tubing.

3. The hydraulic drilling system of claim 2 further comprising an upper sealing element proximate a proximate end of the work string and sealingly engaged between the interior surface of the work string and the connection string.

4. The hydraulic drilling system of claim 3 further comprising a port provided below the upper sealing element to allow drilling fluid to be routed to the annulus.

5. The hydraulic drilling system of claim 1 wherein a drill head is provided on the distal end of the drill tubing.

6. The hydraulic drilling system of claim 5 wherein the drill head includes a nozzle.

7. The hydraulic drilling system of claim 1 wherein the whipstock changes the direction of the drill tubing as the drill tubing advances through the bore in the whipstock.

8. The hydraulic drilling system of claim 7 wherein the direction of the drill tubing is changed from substantially axial relative to the wellbore to substantially laterally to the well bore.

9. The hydraulic drilling system of claim 1 wherein the connection string is a rod string.

10. The hydraulic drilling system of claim 9 wherein the proximate end of the connection string is connectable to a drawworks on a rig.

11. The hydraulic drilling system of claim 10 wherein drawworks of the rig can control the advancement or retraction of the drill tubing through the whipstock.

12. The hydraulic drilling system of claim 1 wherein the connection string is coiled tubing or continuous rod.

13. The hydraulic drilling system of claim 12 wherein the proximate end of the connection string is engageable with an injector head.

14. The hydraulic drilling system of claim 13 wherein the injector head can control the advancement or retraction of the drill tubing through the whipstock.

15. The hydraulic drilling system of claim 13 further comprising a gooseneck for assisting the injector head to feed the connection string into the work string.

16. The hydraulic drilling system of claim 1 wherein a one way valve is provided between the flow through device and the inner bore of the connection string.

17. A method of hydraulic drilling, the method comprising:

sealingly engaging a whipstock with an interior surface of a work string at a distal end of the work string, the whipstock having a bore passing therethrough;

providing a drilling apparatus having:

drill tubing having an inner bore, a proximate end and a distal end; and a flow through device, the flow through device having at least one conduit placing an annulus formed by the interior surface of the work string in fluid communication with the inner bore of the drill tubing when the drilling apparatus is inserted in the work string;

connecting the drilling apparatus to a connection string and inserting the drilling apparatus down into the work string;

inserting at least a portion of the drill tubing through the whipstock;

introducing pressurized drilling fluid into the annulus formed by the work string and the connection string, the pressurized drilling fluid passing through the flow through device into the drilling tube and discharged out the distal end of the drill tubing;

providing an inner bore passing through the connection string, the inner bore of the connection string in fluid communication with the flow through device; and passing an additional fluid through the inner bore of the connection string to mix with drilling fluid from the annulus in the flow through device before entering the inner bore of the drill tubing.

18. The method of claim 17 further comprising controlling the advancement or retraction of the drill tubing through the whipstock using a rig drawworks connected to the upper end of the connection string.

19. The method of claim 17 wherein a first seal is provided at the distal end of the work string between the drill tubing and the interior surface of the work string.

20. The method of claim 19 wherein a second seal is provided at a proximate end of the work string between the connection string and the interior surface of the work string.

21. The method of claim 17 wherein the method is performed for drilling a borehole from a wellbore, and the wellbore is one of: vertical, deviated and horizontal.

22. The method of claim 17 wherein a drill head is provided on the distal end of the drill tubing.

23. The method of claim 22 wherein the drill head comprises a nozzle.

24. The method of claim 17 wherein as the drill tubing is extended through the whipstock, the whipstock alters the direction of the drill tubing.

25. The method of claim 17 wherein the drilling fluid discharged from the distal end of the drill tubing is directed substantially laterally from a direction of the well bore to form a second borehole oriented substantially laterally from the wellbore.

26. The method of claim 17 wherein the additional fluid is at least one of: water, acids; potassium chloride; abrasive slurry and nitrogen.

27. The method of claim 17 wherein the connection string is continuous and further comprising controlling the advancement or retraction of the drill tubing through the whipstock using an injector head engaged with the upper end of the connection string.

28. The method of claim 27 wherein the connection string is coiled tubing or continuous rod.

29. The method of claim 27 further comprising guiding the connection string into or out of the work string using a gooseneck.

30. A hydraulic drilling system, the system comprising:

a work string for placement down a wellbore having a distal end, a proximate end and an interior surface;

a whipstock provided at the distal end of the work string and having a bore;

a connection string provided passing inside the work string, the connection string forms an annulus between the connection string and the interior surface of the work string, the connection string having a proximate end and a distal end;

a drilling apparatus connected to the distal end of the connection string, the drilling apparatus having a flow through device connected to a proximate end of a drill tubing, the drill tubing having an inner bore open at a distal end of the drill tubing, the flow through device having at least one conduit placing the annulus in fluid communication with the inner bore of the drill tubing, the drill tubing passing through the bore of the whipstock; and an injector head, wherein the connection string is continuous and the injector head engages a section of the connection string for controlling the advancement or refraction of the drill tubing through the whipstock, and when pressurized drilling fluid is introduced into the annulus, the drilling fluid can enter the drill tubing through the flow through device and be discharged out the distal end of the drill tubing.

31. The hydraulic drilling system of claim 30 wherein the connection string is coiled tubing or continuous rod.

32. The hydraulic drilling system of claim 30 further comprising a gooseneck for assisting the injector head to feed the connection string into the work string.

33. A method of hydraulic drilling, the method comprising:

sealingly engaging a whipstock with an interior surface of a work string at a distal end of the work string, the whipstock having a bore passing therethrough;

providing a drilling apparatus having:

drill tubing having an inner bore, a proximate end and a distal end; and a flow through device, the flow through device having at least one conduit placing an annulus formed by the interior surface of the work string in fluid communication with the inner bore of the drill tubing when the drilling apparatus is inserted in the work string;

connecting the drilling apparatus to a connection string and inserting the drilling apparatus down into the work string, the connection string being continuous;

inserting at least a portion of the drill tubing through the whipstock;

introducing pressurized drilling fluid into the annulus formed by the work string and the connection string, the pressurized drilling fluid passing through the flow through device into the drilling tube and discharged out the distal end of the drill tubing; and controlling the advancement or retraction of the drill tubing through the whipstock by engaging an injector head with a portion of the connection string.

34. The method of claim 33 wherein the connection string is coiled tubing or continuous rod.

35. The method of claim 33 further comprising guiding the connection string into or out of the work string using a gooseneck.

* * * * *